US007580652B2

(12) United States Patent
Hatama

(10) Patent No.: US 7,580,652 B2
(45) Date of Patent: Aug. 25, 2009

(54) PRINTER APPARATUS WITH OPEN/CLOSE DOOR AND LASER BEAM PRINTER APPARATUS WITH OPEN/CLOSE DOOR

(75) Inventor: Takahiko Hatama, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 387 days.

(21) Appl. No.: 11/325,067

(22) Filed: Jan. 4, 2006

(65) Prior Publication Data

US 2006/0147224 A1 Jul. 6, 2006

(30) Foreign Application Priority Data

Jan. 4, 2005 (JP) ..... 2005-000172

(51) Int. Cl.
*G03G 15/00* (2006.01)

(52) U.S. Cl. ..... 399/107

(58) Field of Classification Search ..... 399/107, 399/121, 124

See application file for complete search history.

(56) References Cited

U.S. PATENT DOCUMENTS

2004/0037588 A1* 2/2004 Iida ..... 399/124

FOREIGN PATENT DOCUMENTS

JP 4-90232 8/1992
JP 10-078737 3/1998
JP 2003-084335 3/2003
JP 2004-132407 4/2004

OTHER PUBLICATIONS

Patent Abstracts of Japan, Publication No. 2004-132407, dated Apr. 30, 2004 (1 page).
Patent Abstracts of Japan, Publication No. 2003-084335, dated Mar. 19, 2003 (1 page).
Patent Abstracts of Japan, Publication No. 10-078737, dated Mar. 24, 1998 (2 pages).
Partial English Translation of Application No. 4-90232, dated Aug. 6, 1992 (2 pages).

* cited by examiner

*Primary Examiner*—David M Gray
*Assistant Examiner*—Joseph S Wong
(74) *Attorney, Agent, or Firm*—Osha • Liang LLP

(57) ABSTRACT

A laser beam printer apparatus includes a rear door configured to be openable/closable, and a holding member including a guide groove for guiding the rear door to a position where the rear door is being stopped when the rear door is being closed. The rear door includes a boss configured to be partially inserted into the guide groove when the rear door is being closed. The boss includes an abutting portion biased toward the end facing the guide groove. The holding member has a hole on the guide groove in a position where the abutting portion abuts it when the rear door is closed. The boss is configured such that its tip fits into the hole when the rear door is closed and the tip is removed from the hole when the rear door is being opened.

7 Claims, 11 Drawing Sheets

PRINTER APPARATUS WITH OPEN/CLOSE DOOR AND LASER BEAM PRINTER APPARATUS WITH OPEN/CLOSE DOOR

BACKGROUND OF THE INVENTION

1. Field of the Invention

The present invention relates to a printer apparatus. Particularly, it relates to a laser beam printer apparatus.

2. Description of the Background Art

Printer apparatus that perform printing on a printing substrate such as a sheet of paper include laser beam printer apparatus. A laser beam printer apparatus performs printing by pressing a printing substrate upon a photosensitive drum on which toner has been placed in a predetermined geometry.

FIG. 18 illustrates a schematic cross section of a laser beam printer apparatus. The laser beam printer apparatus includes a housing 30 in which its various components are disposed. The laser beam printer apparatus includes a toner cartridge 25 containing toner, a photosensitive drum 11 for placing toner on a printing substrate in a desired geometry, and a transfer roller 12 for pressing the substrate onto photosensitive drum 11 with an appropriate pressing force. The printing substrate is shaped such that it can be moved along a transportation path 51.

The laser beam printer apparatus includes a rear door 1 disposed on the backside of housing 30. Rear door 1 is configured to be openable/closable as indicated by arrow 61. Transfer roller 12 is fixed to rear door 1. Closing rear door 1 causes photosensitive drum 11 to contact transfer roller 12 in a line. Further, transfer roller 12 is biased toward photosensitive drum 11 with a predetermined pressing force by a biasing means, not shown.

Preferably, transfer roller 12 is precisely arranged to be adjusted in its position relative to photosensitive drum 11 in order to place toner in a configuration to be printed. For example, the rotational axis of transfer roller 12 preferably is highly parallel with the rotational axis of photosensitive drum 11. Accordingly, the position of rear door 1 is preferably fixed such that it is not moved when rear door 1 is closed. For example, rear door 1, when closed, is preferably positioned precisely in the front/back direction and in the up/down direction of the laser beam printer apparatus.

To arrest an open/close member such as a door in a predetermined position, Japanese Patent Laying-Open No. 2004-132407, for example, discloses a hinge device for a mobile phone. The hinge device includes a slide piece having a linear recess and a cam member having a linear cam projection corresponding to the recess. The slide piece and the cam member are configured such that the recess and the projection oppose each other and are pressed against each other by a biasing means. The cam member is configured to be rotated with respect to the slide piece. In this mobile phone, the receiver part is fixed such that the cam projection is substantially parallel to the recess. Thus, when the cam projection of the cam member and the recess of the slide piece are aligned with each other in extension, the cam projection is fitted into the recess of the slide piece, and one of the housings of the hinge device is fixed.

Japanese Utility Model Laying-Open No. 4-90232 discloses an information device including an openable/closable display case. This information device provides a lock projection on one of its body cases and a lock recess on the other, which engages with the lock projection. It discloses the lock projection engaging the lock recess to prevent one of the display cases configured to be openable/closable from being disengaged. Particularly, it discloses the lock projection protruding in the direction of the rotational axis of the openable/closable display case to prevent the lock projection from being disengaged from the recess even when an external force is applied to the openable/closable display case to cause deformation.

In a laser beam printer apparatus illustrated in FIG. 18, it is preferable if transfer roller 12 is precisely positioned with respect to photosensitive drum 11 when rear door 1 is closed. That is, transfer roller 12 preferably is fixed such that it is not movable when rear door 1 is closed. If rear door 1 wobbles when rear door 1 is closed, toner cannot be placed in correct position on a printing substrate such as paper, for example the transfer roller shifts while toner is being placed which results in a disturbed transferred geometry. Thus, some printer apparatus may have an open/close door that is preferred to be precisely positioned when closed.

A hinge device disclosed in Japanese Patent Laying-Open No. 2004-132407 as above is suitable for a smaller device such as a mobile phone, however, it is not appropriate for a larger device such as an open/close door of a printer apparatus since a large force is applied to its rotational axis.

A lock projection such as in an information device disclosed in Japanese Utility Model Laying-Open No. 4-90232 is capable of fixing an open/close door in one direction related to the anchoring by the lock projection, however, it is not capable of fixing the open/close door in a direction perpendicular to the above one direction, such that the open/close door may be moved in a direction perpendicular to the one direction.

SUMMARY OF THE INVENTION

An object of the present invention is to provide a printer apparatus and a laser beam printer apparatus that allows an open/close door to be precisely positioned and fixed when the open/close door is closed.

A laser beam printer apparatus in one aspect of the present invention includes: a rear door configured to be openable/closable around a rotational axis that is an axis extending in a width direction of its base portion; a cylindrical photosensitive drum; a cylindrical transfer roller fixed to the rear door, the transfer roller being disposed to be contactable with the photosensitive drum in a line when the rear door is closed; a holding member including a guide groove extending toward a backside; and a hook for restraining the rear door in a closed state. The rear door includes: a rear latch engaging the hook when the rear door is closed; and a boss configured to be partially inserted into the guide groove when the rear door is being closed. The holding member has a hole that is circular in shape in a plan view at a bottom of the guide groove in a position where the boss is disposed when the rear door is closed. The boss includes: a cylindrical case that opens at an end portion at one boss end facing the guide groove; and a cylindrical abutting portion disposed within the case, the abutting portion being disposed to abut the guide groove. The boss includes: an anchoring lug extending from the abutting portion toward another boss end opposite the one boss end, the anchoring lug configured to catch an end portion of the case at the other boss end; and a coil spring disposed within the case for biasing the abutting portion toward the one boss end. The guide groove is formed along a path along which the boss is moved as the rear door is opened/closed. The abutting portion has a spherical tip abutting the guide groove. The hole has a diameter in a plan view that is smaller than that of the abutting portion. When the rear door is closed, the rear latch engages the hook to restrain the rear door in a closed state. When the rear door is being closed, part of the boss is inserted into the guide groove, and the tip fits into the hole such that a closed position of the rear door is fixed. This configuration provides a laser beam printer apparatus that allows the rear door to be precisely positioned and fixed when the rear door is closed.

A printer apparatus in another aspect of the present invention includes: an open/close door configured to be openable/closable around a rotational axis that is an axis extending in one direction; and a frame including a guide groove for guiding the open/close door to a position where the open/close door is to be stopped when the open/close door is being closed. The open/close door includes a boss configured to be partially inserted into the guide groove when the open/close door is being closed. The boss includes an abutting portion biased toward one boss end facing the guide groove. The frame includes a recess or a through hole at the guide groove in a position where the abutting portion abuts it when the open/close door is closed. The boss is configured such that a tip fits into the recess or the through hole when the open/close door is closed and the tip is removed from the recess or the through hole when the open/close door is being opened. This configuration provides a printer apparatus that allows the open/close door to be precisely positioned and fixed when the open/close door is closed.

Preferably, in the above invention, the boss includes: a pipe-shaped case that opens at an end portion at the one boss end; the abutting portion that is shaped as a rod disposed within the case, the abutting portion configured to be movable toward the one boss end; an anchoring lug extending from the abutting portion, the anchoring lug configured to catch an end portion of the case at a boss end opposite the one boss end; and a coil spring disposed within the case for biasing the abutting portion toward the one boss end. This configuration allows the boss to be easily constructed. Further, by changing coil springs, the force biasing the abutting portion toward the one boss end can be easily adjusted.

Preferably, in the above invention, the boss includes: a boss support; the abutting portion that is shaped as a rod; a pinching portion configured to pinch the abutting portion while permitting it to be moved toward the one boss end; and a plate spring extending from the abutting portion for biasing the abutting portion toward the one boss end. The plate spring is fixed to the boss support on an end opposite that connected with the abutting portion and is formed to be bent. This configuration allows the boss to be easily constructed. It also allows reduction in the number of components, improving the productivity.

Preferably, in the above invention, the abutting portion is cylindrical, and the abutting portion is shaped such that a tip at the one boss end is spherical. The hole or the recess is circular in shape in a plan view, and the tip has a diameter that is larger than that of the hole. This configuration provides a simple arrangement for the boss that can be fitted into or removed from the hole or the recess.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Referring to FIGS. 1 to 9 and 18, a printer apparatus and a laser beam printer apparatus of a first embodiment of the present invention will be described.

Figure 18:
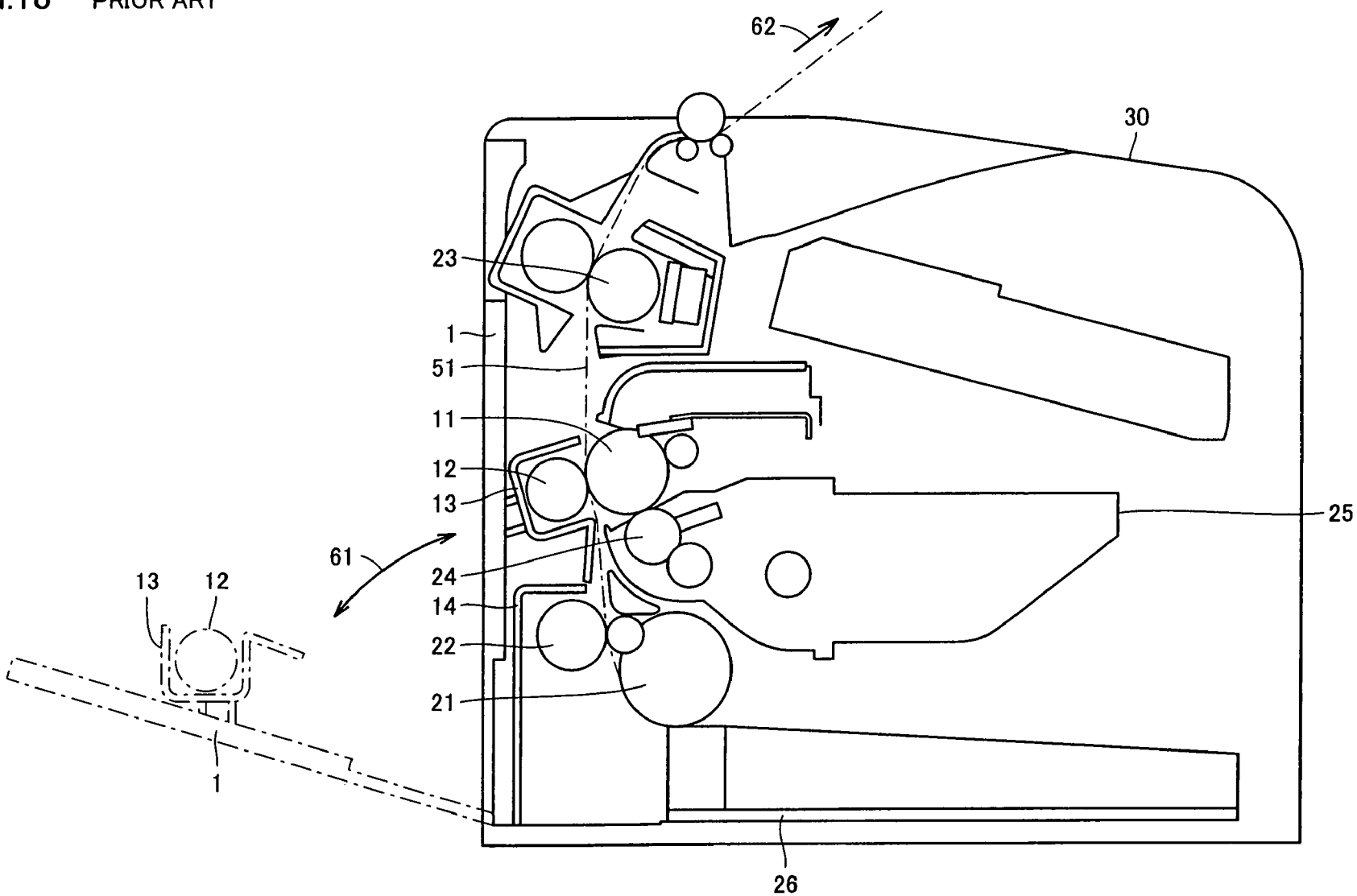
FIG.18 PRIOR ART
FIG. 18 is a schematic cross section of a laser beam printer apparatus.

FIG. 18 illustrates a schematic cross section of a laser beam printer apparatus. The various components of the laser beam printer apparatus are disposed within housing 30. Toward the bottom of housing 30, a paper tray 26 is disposed in which sheets of paper or cellophane or the like as a printing substrate are disposed. A pick roller 21 is disposed above one end of paper tray 26 for taking out a sheet of paper, for example, from paper tray 26. Such a sheet of paper, for example, is transported along a transportation path 51, as indicated by arrow 62.

Near transportation path 51, a transportation roller 22 for transporting a sheet of paper, for example, along transportation path 51, a photosensitive drum 11 for placing toner on the surface of a printing substrate in a desired geometry, and a transfer roller 12 are disposed. Also, a fixing roller 23 is disposed near transportation path 51, by means of which toner placed on the surface of a printing substrate can be fixed on the surface of the substrate.

A toner cartridge 25 is disposed generally in the center of housing 30. Toner cartridge 25 is filled with toner. Toner cartridge 25 is configured to be replaceable. In FIG. 18, the right as viewed facing the paper is the front of the printer, and a printing substrate such as a sheet of paper is shaped such that it can be ejected toward the front of the printer apparatus.

Photosensitive drum 11 is disposed toward the rear within housing 30. Photosensitive drum 11 is disposed to be in contact with a developer roll 24. The various rollers such as photosensitive drum 11, transfer roller 12, developer roll 24 are cylindrical in shape.

An openable/closable rear door 1 as an open/close door is provided on the backside of the laser beam printer apparatus. Rear door 1 is shaped as a flat plate. Rear door 1 has a rotational axis in its base portion that has an axial direction parallel to its width direction. Thus, rear door 1 is configured to be openable/closable around a rotational axis that is an axis extending in the width direction of the base portion. Rear door 1 is configured to be rotatable as indicated by arrow 61.

Around transfer roller 12, a transfer roller guide 13 is provided to surround part of transfer roller 12. Transfer roller 12 and transfer roller guide 13 are fixed to rear door 1 and are movable together with rear door 1. The various rollers except transfer roller 12 are fixed to the body of the laser beam printer apparatus. For example, photosensitive drum 11 is fixed to the body of the laser beam printer apparatus and is configured to remain unmoved when rear door 1 is opened/closed.

Transfer roller 12 is biased toward photosensitive drum 11 by an elastic member, not shown. Photosensitive drum 11 and transfer roller 12 are arranged such that their rotational axes lie parallel to each other when rear door 1 is closed. Photosensitive drum 11 and transfer roller 12 are configured to come into contact with each other in a line when rear door 1 is closed.

A guide frame 14 is disposed behind transportation roller 22, covering part of transportation roller 22. Guide frame 14 is shaped as a plate. Guide frame 14 has an L-shaped cross section.

Figure 1:
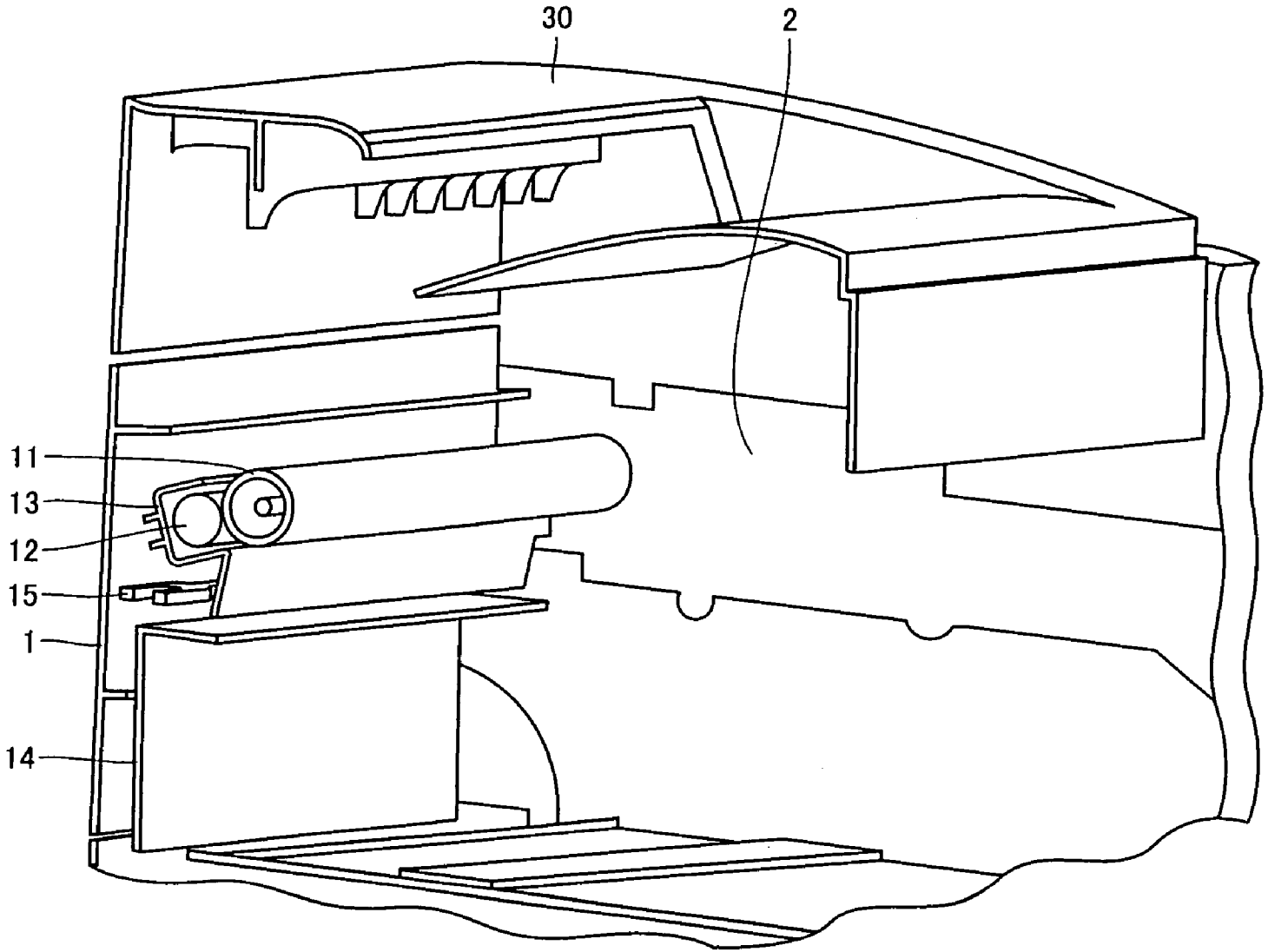
FIG. 1 is a cutaway view of a laser beam printer apparatus of a first embodiment.

FIG. 1 shows a perspective cutaway view of the back portion of the laser beam printer apparatus. Photosensitive drum 11 has a rotational axis in a direction substantially parallel to the width direction of the laser beam printer apparatus. Photosensitive drum 11 is fixed to a holding member 2 that serves as a frame. Holding member 2 is fixed to housing 30. Thus, photosensitive drum 11 is fixed to the body of the laser beam printer apparatus.

Transfer roller 12 is disposed such that its rotational axis lies in a direction substantially parallel to the width direction of the laser beam printer apparatus. Thus, transfer roller 12 is disposed such that its rotational axis lies in a direction parallel to that of photosensitive drum 11.

Outside transfer roller guide 13, a rear latch 15 is provided between transfer roller 12 and guide frame 14. Rear latch 15 has a U-shaped tip. Rear latch 15 is disposed on rear door 1 and is configured to be moved together with rear door 1 as rear door 1 is opened/closed. Rear latch 15 is configured to engage a hook fixed to the body of the laser beam printer apparatus when rear door 1 is closed.

Figure 2:
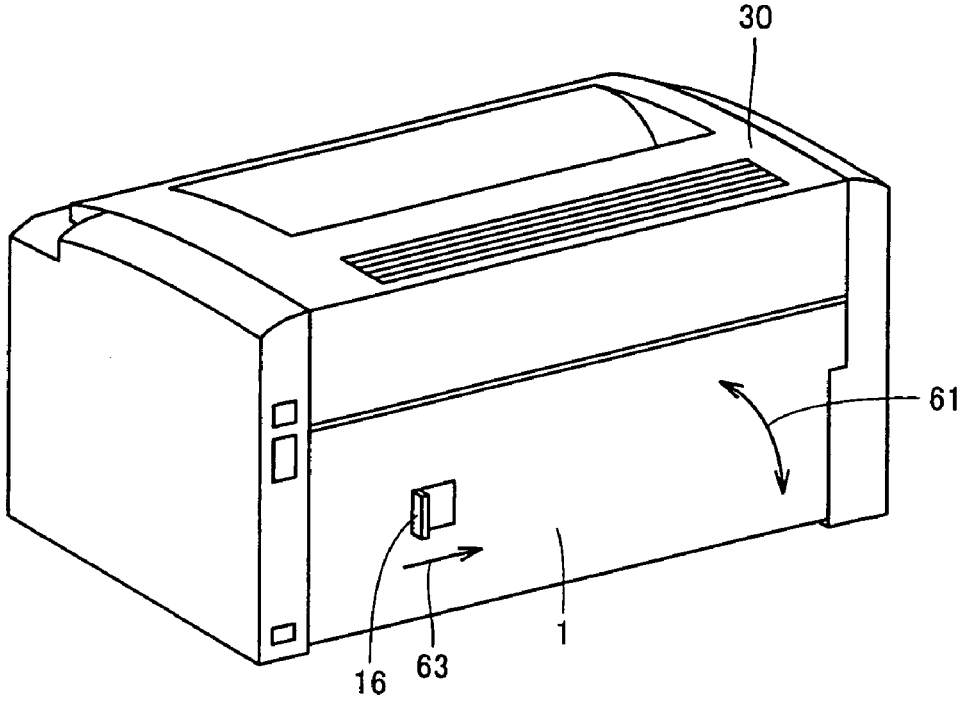
FIG. 2 is a perspective elevation of the laser beam printer apparatus of the first embodiment.

FIG. 2 shows a schematic perspective elevation of the laser beam printer apparatus as viewed from behind. FIG. 2 shows the apparatus with rear door 1 being closed. Rear door 1 is configured to be openable/closable in the direction indicated by arrow 61.

Rear door 1 includes a rear latch operating element 16. Rear latch operating element 16 is configured to be biased in the direction opposite that of arrow 63. Rear latch operating element 16 is configured to be movable in the direction indicated by arrow 63. Rear latch operating element 16 may be moved in the direction indicated by arrow 63 to move the rear latch, which makes rear door 1 openable.

Figure 3:
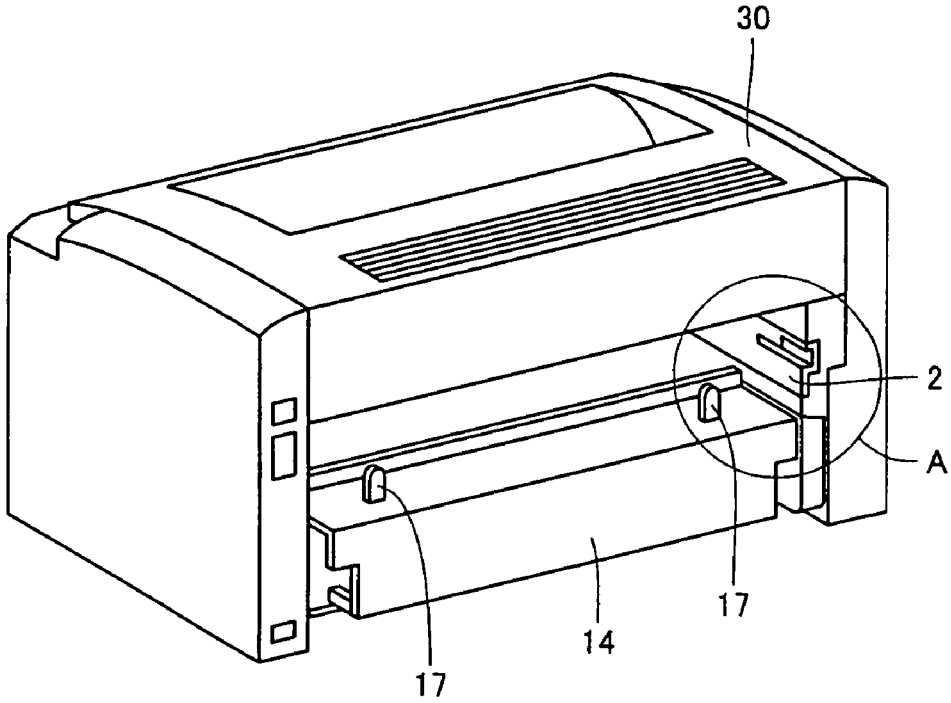
FIG. 3 is a perspective rear elevation of the laser beam printer apparatus of the first embodiment where the rear door is removed.

FIG. 3 shows a perspective elevation of the laser beam printer apparatus with its rear door removed. When the rear door is removed, a guide frame 14 is exposed. Two hooks 17 are provided on the upper surface of guide frame 14 for catching their respective rear latches 15. Hooks 17 are shaped to protrude from the surface of guide frame 14 toward above. A holding member 2 is disposed by the side of guide frame 14.

Figure 4:
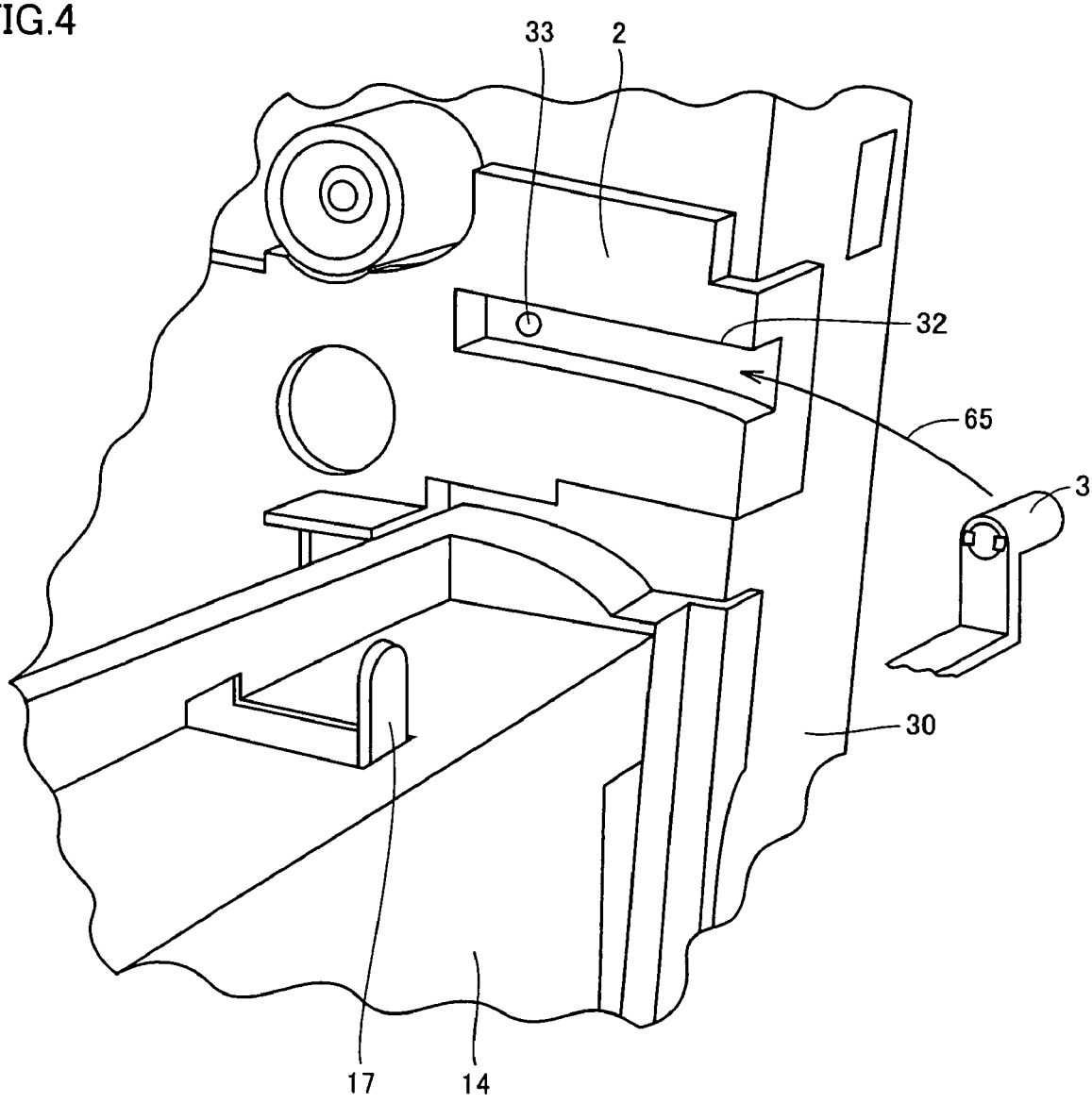
FIG. 4 is an enlarged perspective view of the laser beam printer apparatus of the first embodiment where the rear door is removed.

FIG. 4 shows an enlarged perspective view of the region A in FIG. 3. Holding member 2 has a guide groove 32 extending toward the backside. Guide groove 32 of the present embodiment extends substantially horizontally. Guide groove 32 opens at its backside portion as observed along its extension. Guide groove 32 is shaped such that its portion at the opening on the backside is larger in its width direction. Further, guide groove 32 is shaped such that the portion at the opening on the backside has a larger depth.

Guide groove 32 is configured to allow part of a boss 3 on rear door 1, described later, to be introduced into it. Moreover, guide groove 32 is formed along the path along which boss 3 is moved when the rear door is being opened/closed. Holding member 2 has a hole 33 in the bottom of guide groove 32 in the position where boss 3 is disposed when the rear door is closed. Hole 33 is formed through holding member 2. Hole 33 is circular in shape in a plan view.

Hook 17 of the present embodiment is shaped as a flat plate and has a major surface substantially parallel to the width direction of the laser beam printer apparatus. Hook 17 is configured to allow the tip of a rear latch to engage it to restrain the rear door in a closed position.

Figure 5:
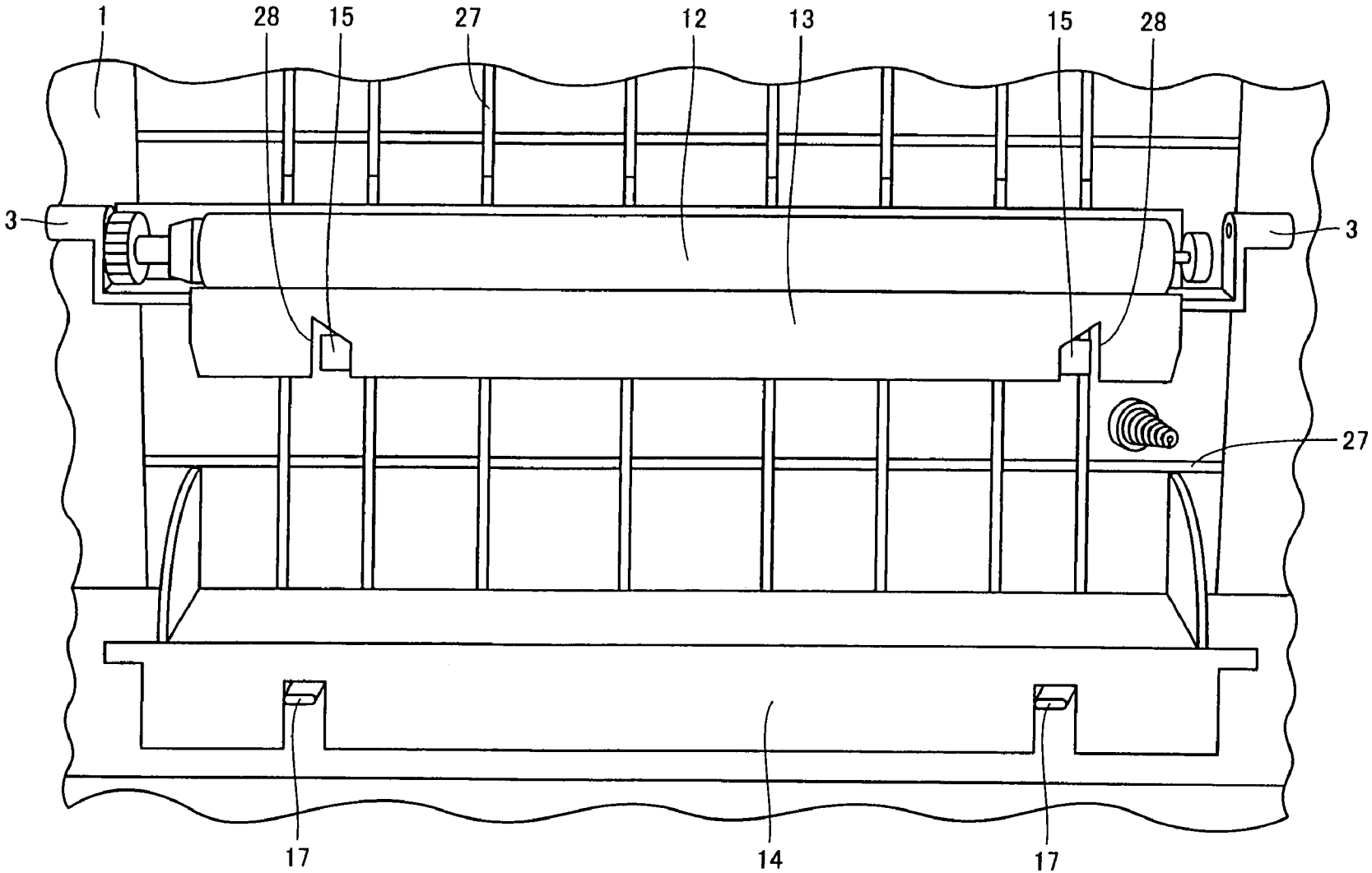
FIG. 5 is a schematic plan view of the laser beam printer apparatus of the first embodiment where the rear door is opened.

FIG. 5 shows a plan view of the rear door which is opened, as viewed from above. Ribs 27 are formed on the inside of rear door 1 for increasing the strength of rear door 1. Transfer roller 12 and transfer roller guide 13 are disposed inside rear door 1. A boss 3 is provided from a side of transfer roller guide 13 toward the outside as observed in the width direction. In the present embodiment, two bosses 3 are provided toward the outside in the width direction.

A notch 28 is formed in transfer roller guide 13 for making rear latch 15 accessible through notch 28. Notch 28 is provided in a position corresponding to the position of a hook 17 when rear door 1 is closed.

Referring to FIGS. 4 and 5, boss 3 of the present embodiment is cylindrical and the diameter of the cylinder corresponds to the width of guide groove 32. That is, boss 3 is configured to be restrained in its movement in the up/down direction when part of boss 3 is introduced into guide groove 32, as indicated by arrow 65.

Figure 6:
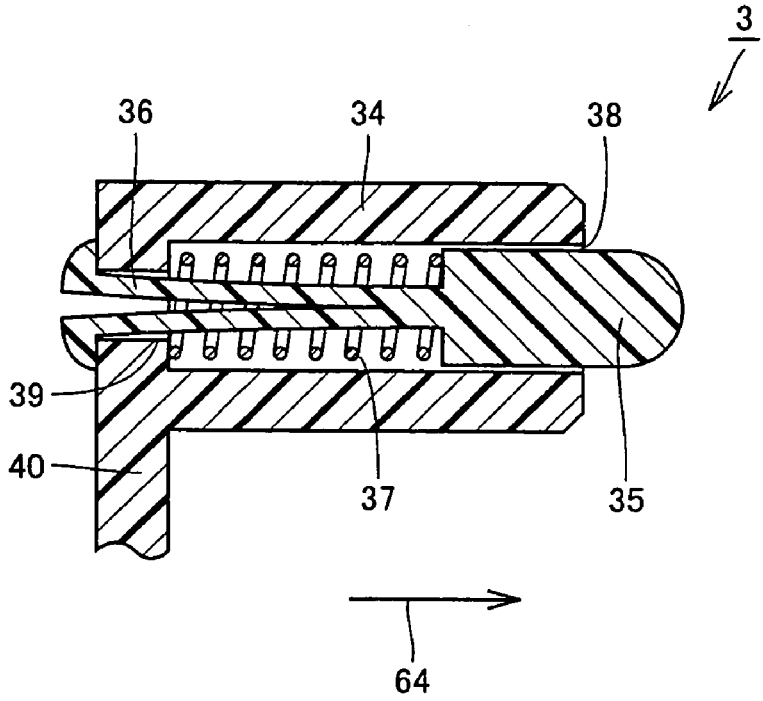
FIG. 6 is a cross sectional view of a boss of the first embodiment.
Figure 7:
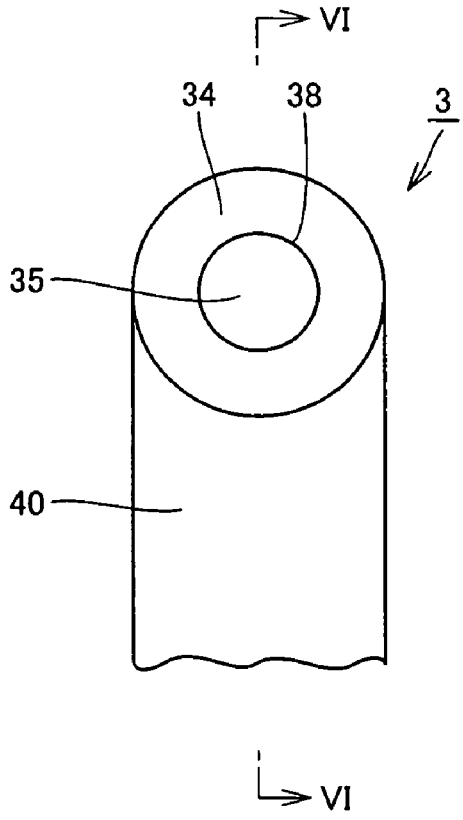
FIG. 7 is a front view of the boss of the first embodiment.

FIG. 6 shows a schematic cross section of the boss of the present embodiment. FIG. 7 shows a front view of the boss of the present embodiment. FIG. 6 is a view in the direction of the arrow of VI-VI in FIG. 7. Boss 3 includes a cylindrical case 34 opening at one end that faces the guide groove. Boss 3 includes a rod-like abutting portion 35 within case 34, disposed to abut the guide groove. In the present embodiment, abutting portion 35 is cylindrical.

Boss 3 includes an anchoring lug 36 extending from abutting portion 35 toward the end opposite that facing the guide groove. Boss 3 has a coil spring 37 as an elastic member disposed within case 34 for biasing abutting portion 35 in the direction indicated by arrow 64. Coil spring 37 is made of metal. Arrow 64 indicates the direction toward the guide groove.

Case 34 has an opening 38 at one end toward which arrow 64 points. Further, case 34 has an opening 39 at the end opposite opening 38. Case 34 is supported on boss support 40. Boss support 40 is shaped as a plate.

Anchoring lug 36 extends in the axial direction of case 34. Anchoring lug 36 of the present embodiment includes two lug portions. Anchoring lug 36 is disposed such that part of it protrudes from opening 39. Anchoring lug 36 is configured to catch the end of case 34 having opening 39. Each of the two lug portions of anchoring lug 36 is elastic and is biased toward the outside in the radial direction of case 34.

Abutting portion 35 is shaped such that the tip contactable with the guide groove is spherical. Coil spring 37 is disposed within case 34 and is configured to abut the interior surface at one end of case 34 and one end surface of abutting portion 35. Abutting portion 35 is configured to be movable in the direction toward the guide groove and in the direction opposite the direction toward the guide groove. The spherical tip of abutting portion 35 has a diameter larger than that of hole 33 (see FIG. 4) provided on the bottom of guide groove 32 of holding member 2. That is, the tip of the abutting portion is shaped so as not to pierce through the hole.

Referring to FIG. 18, sheets of paper, for example, are taken from paper tray 26 by pick roller 21 one at a time, which is transported toward photosensitive drum 11 by transportation roller 22. Developer roll 24 is rotated to supply photosensitive drum 11 with toner disposed within toner cartridge 25. The sheet of paper, for example, is transported between photosensitive drum 11 and transfer roller 12 while toner is placed upon the surface in a configuration to be printed. The sheet of paper, for example, having toner placed upon it is fed between fixing rollers 23 where toner is fixed onto the paper, for example. The sheet of paper, for example, is then transported to the outlet by the transportation roller and other components.

When paper jamming, for example, occurs along transportation path 51, rear door 1 is opened to remove the paper, for example, which is jammed inside. When one of the interior components fails, rear door 1 is also opened and repairs to the interior are made. Thus, the laser beam printer apparatus is configured to allow maintenance and repair inside the housing by the opening of rear door 1.

Referring to FIGS. 1 to 3, when rear door 1 is to be opened, rear latch operating element 16 is translated in the direction indicated by arrow 63 of FIG. 2. Moving rear latch operating element 16 causes rear latch 15 to be removed from hook 17 to release the restraint of rear door 1. In this way, rear door 1 can be opened.

Referring to FIG. 4, when rear door 1 is to be closed, boss 3 which is integral with rear door 1 is partially disposed within guide groove 32. Boss 3 is moved in the direction in which guide groove 32 extends, as indicated by arrow 65. Since guide groove 32 is formed along the path along which the boss is moved as the rear door is opened/closed, part of boss 3 remains within guide groove 32 during the movement.

Guide groove 32 has a larger width at the opening on the backside or has a larger depth at the opening. The use of one of these configurations allows boss 3 to be properly guided along guide groove 32 even when rear door 1 wobbles.

Referring to FIGS. 1 to 3, rear latch 15 engages hook 17 while rear door 1 is completely closed. Referring to FIG. 2, rear latch operating element 16 is biased in the direction opposite that of arrow 63 such that the rear latch engages the hook without an operation of rear latch operating element 16. In this way, rear door 1 is restrained in its movement such that it does not open.

Figure 8:
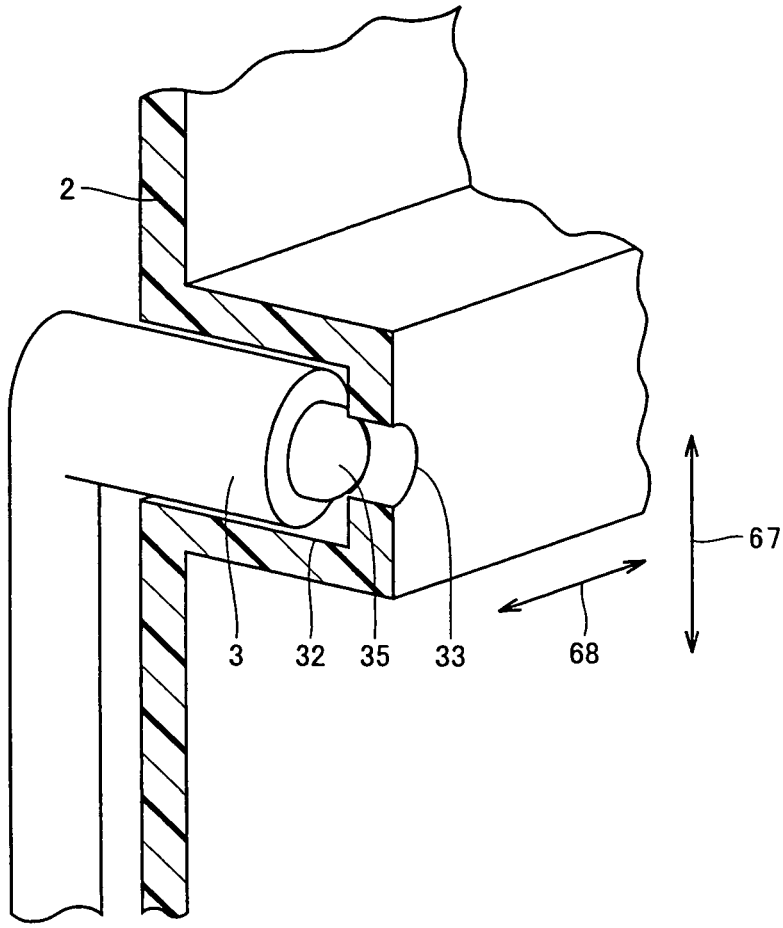
FIG. 8 is a partial perspective cutaway of the boss of the first embodiment when the rear door is closed.
Figure 9:
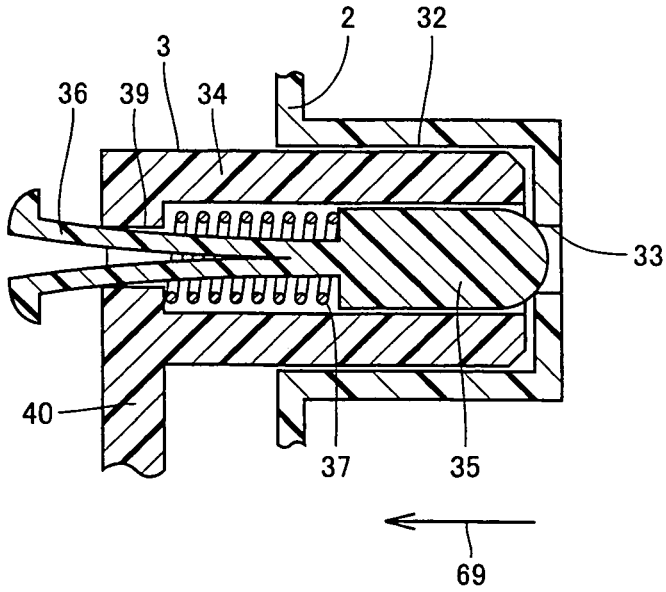
FIG. 9 is a cross sectional view of the boss of the first embodiment when the rear door is closed.

FIG. 8 shows an enlarged perspective cutaway of the boss and the guide groove when the rear door is completely closed. FIG. 9 shows a schematic cross section of the boss and the guide groove when the rear door is completely closed. Hole 33 formed in the bottom of guide groove 32 is located opposite boss 3 when the rear door is closed. The tip of abutting portion 35 is spherical. Further, hole 33 has a diameter smaller than that of abutting portion 35. Abutting portion 35 is biased toward the bottom of guide groove 32 by coil spring 37. This configuration allows, when the rear door is to be closed, part of boss 3 to be introduced into guide groove 32 and abutting portion 35 to be moved in the direction indicated by arrow 69 of FIG. 9. Thereafter, part of the tip of abutting portion 35 fits into hole 33 when the rear door is in a closed position. Particularly, a spherical portion of the tip of abutting portion 35 fits into hole 33.

Referring to FIG. 8, the tip of abutting portion 35 may fit into hole 33 such that boss 3 can be restrained at hole 33 in the direction in which guide groove 32 extends, indicated by arrow 68. Thus, the rear door is restrained in its position in the horizontal direction, i.e. the direction in which it begins to open.

In FIG. 8, boss 3 is shaped to correspond to the shape of guide groove 32 to restrain boss 3 in the up/down direction indicated by arrow 67. That is, the width of guide groove 32 may be substantially the same as the size of case 34 of boss 3 in the radial direction to enable restraining the movement of boss 3 in the up/down direction. Or, the tip of abutting portion 35 may fit into hole 33 to enable restraining boss 3 in the up/down direction. As a result, the rear door can be restrained in the up/down direction.

Referring to FIGS. 8 and 9, opening the rear door causes abutting portion 35 to move out of hole 33. As the opening continues, boss 3 moves away from guide groove 32. At this moment, the elasticity of coil spring 37 causes part of abutting portion 35 to protrude from case 34. Since boss 3 has anchoring lug 36, anchoring lug 36 catches the end surface of case 34 to prevent abutting portion 35 from slipping out of case 34.

In this way, in a laser beam printer apparatus of the present embodiment, the rear door can be restrained in the front/back direction as well as in the up/down direction, thereby enabling fixing the rear door in a proper position. For example, fixing it only by the engagement of a rear latch and a hook may result in a wobbling door, whereas providing a guide groove and a boss as in the present embodiment achieves fixing of the rear door in a proper position when the rear door is closed. As a result, in the present embodiment, the photosensitive drum contacts the transfer roller in a line in a proper position, thereby achieving good printing.

Although a gap can be seen between case 34 and guide groove 32 in FIGS. 8 and 9, case 34 preferably is in contact with guide groove 32. Also, although a gap can be seen between abutting portion 35 and case 34, case 34 preferably is in contact with guide groove 32. The use of one of these configurations allows restraining the boss in a position that corresponds to the hole to a greater degree.

The boss of the present embodiment includes a case, an abutting portion configured to be movable within the case, an anchoring lug extending from the abutting portion, the anchoring lug configured to catch an end of the case, and a coil spring for biasing the abutting portion toward the guide groove. This configuration allows the boss of the present embodiment to be constructed with a simple structure. Further, by changing coil springs, the force biasing the abutting portion toward the guide groove can be easily adjusted. Moreover, in the boss of the present embodiment, the coil spring for biasing the abutting portion is formed of metal, thereby providing a boss with improved durability.

The abutting portion of the present embodiment is cylindrical and a tip of the abutting portion is spherical. The hole formed in the guide groove is circular in shape in a plan view, and the diameter of the tip is larger than that of the hole. This configuration provides a simple structure for a boss that can be fitted into and removed from the hole.

While the boss of the present embodiment is cylindrical, it is not limited to this particular form and any shape may be used. Further, while a tip of the abutting portion of the present embodiment is spherical, it is not limited to this particular form and any form is possible that allows the abutting portion to be fitted into and removed from the hole as the open/close door is opened/closed.

Further, in the present embodiment, a boss is provided in each of both sides as observed in the width direction of the laser beam printer apparatus. The rear door includes two bosses, each of which protrudes toward the outside. This configuration allows the rear door to be supported on its both sides as observed in the width direction of the rear door, thereby allowing the rear door to be fixed more stably.

Further, while a hole is provided in the guide groove of the present embodiment, it is not limited to this particular form and a recess may be provided that does not extend through the frame. That is, a hole with a bottom may be provided.

Moreover, while a holding member that serves as a frame to hold a photosensitive drum is provided in the present embodiment, it is not limited to this particular form and it may be any frame that includes a guide groove on a side of the body of the laser beam printer. For example, a separate frame may be provided where a guide groove may be formed.

Further, while the present embodiment illustrates a rear door that serves as an open/close door and is disposed on the backside, it is not limited to this particular form and the present invention may be applied to any open/close door configured to be openable/closable. For example, the present invention may be applied to an open/close door disposed on a side and configured to be rotatable around a rotational axis that is an axis extending vertically.

Finally, while the present embodiment illustrates a laser beam printer, it is not limited to this particular form and may be applied to a printer apparatus having any open/close door.

Second Embodiment

Referring to FIGS. 10 to 13, a laser beam printer apparatus of the present embodiment will be described. The laser beam printer apparatus of the present embodiment is different from the first embodiment in the boss.

Figure 10:
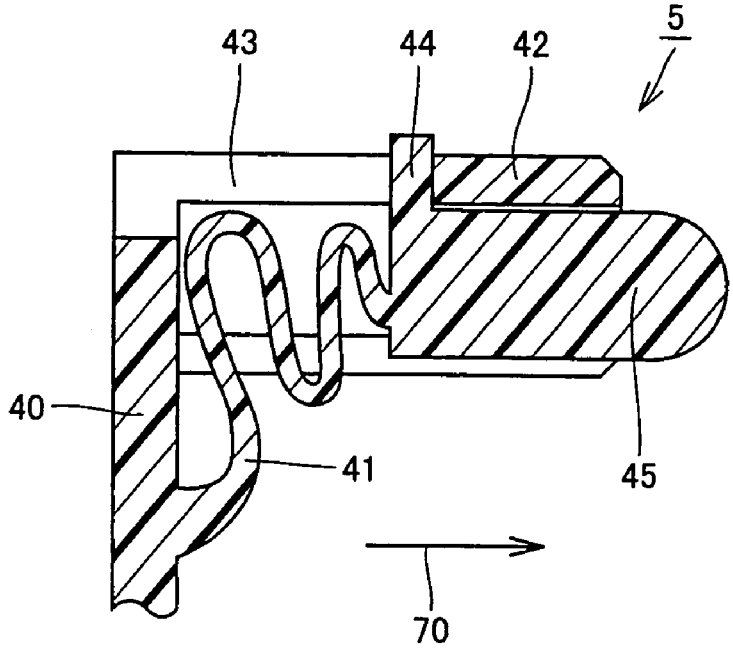
FIG. 10 is a cross sectional view of a boss of a second embodiment.
Figure 11:
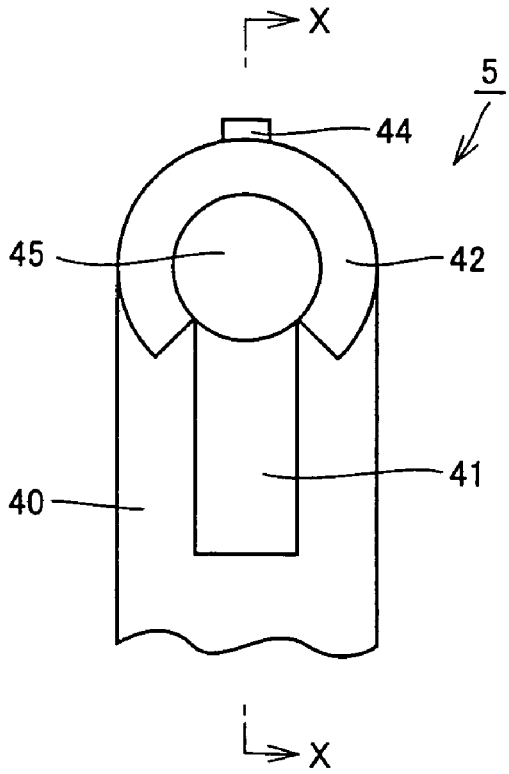
FIG. 11 is a front view of the boss of the second embodiment.

FIG. 10 shows a schematic cross section of a boss of the present embodiment. FIG. 11 shows a front view of the boss of the present embodiment. FIG. 10 is a view in the direction of the arrow of X-X in FIG. 11. Boss 5 includes a boss support 40 connected with the rear door. Boss 5 includes a rod-like abutting portion 45. Abutting portion 45 is cylindrical and has a spherical tip abutting the guide groove. Abutting portion 45 includes a projection 44 protruding on the side of boss 5.

Boss 5 includes a pinching portion 42 surrounding part of abutting portion 45. Pinching portion 42 is elastic and part of the cylinder is notched along its axis. Pinching portion 42 is configured to pinch and support abutting portion 45. Pinching portion 42 includes a slide hole 43 formed along the movement of projection 44. Projection 44 is disposed in slide hole 43.

The boss of the present embodiment has boss support 40, abutting portion 45, plate spring 41 and pinching portion 42 which are integrally formed.

Boss 5 includes a plate spring 41 extending from abutting portion 45 for biasing abutting portion 45 toward the guide groove, as indicated by arrow 70. Plate spring 41 is shaped as a plate. Plate spring 41 is bent several times in its cross section. Plate spring 41 has one end joined with abutting portion 45 and the other end joined with boss support 40. Plate spring 41 is formed of an elastic material.

The rest of the construction is the same as in the first embodiment and thus will not be described again.

Referring to FIG. 10, abutting portion 45 of boss 5 of the present embodiment is moved in the longitudinal direction of pinching portion 42. Abutting portion 45 is biased in the direction indicated by arrow 70 by plate spring 41.

Projection 44 is provided on abutting portion 45, slide hole 43 is provided in pinching portion 42 and projection 44 is disposed in slide hole 43 such that abutting portion 45 is prevented from being removed from pinching portion 42. That is, when the open/close door is opened, projection 44 abuts one brim of slide hole 43, thereby preventing abutting portion 45 from being removed from pinching portion 42.

The boss of the present embodiment includes a boss support, an abutting portion, a pinching portion configured to pinch the abutting portion while permitting it to be moved, and a plate spring extending from the abutting portion for biasing the abutting portion. The plate spring is fixed to the boss support on the end opposing that connected with the abutting portion and is bent. This configuration allows the boss to be constructed with a simple structure.

Figure 12:
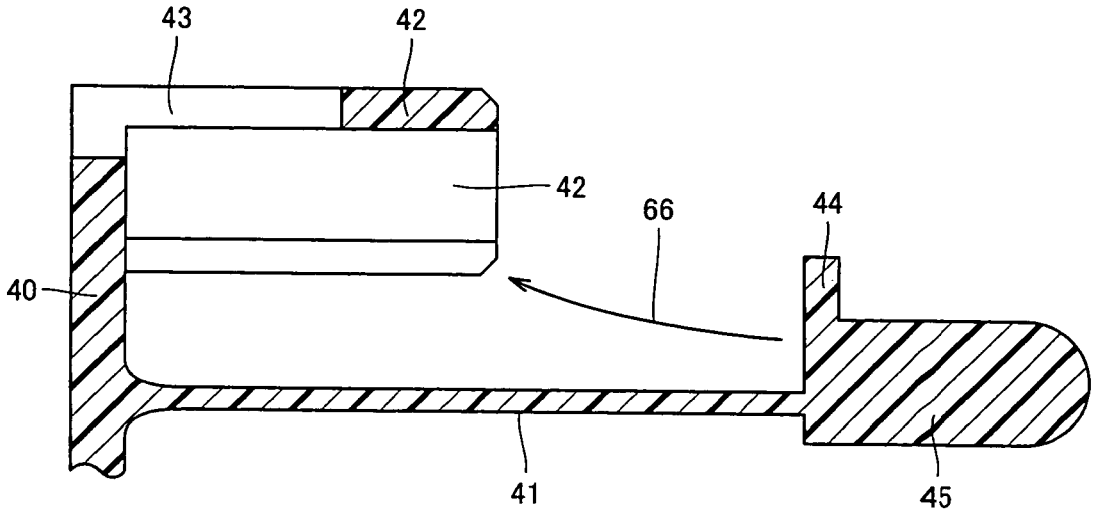
FIG. 12 is a cross sectional view of the boss of the second embodiment illustrating a method of manufacturing it.
Figure 13:
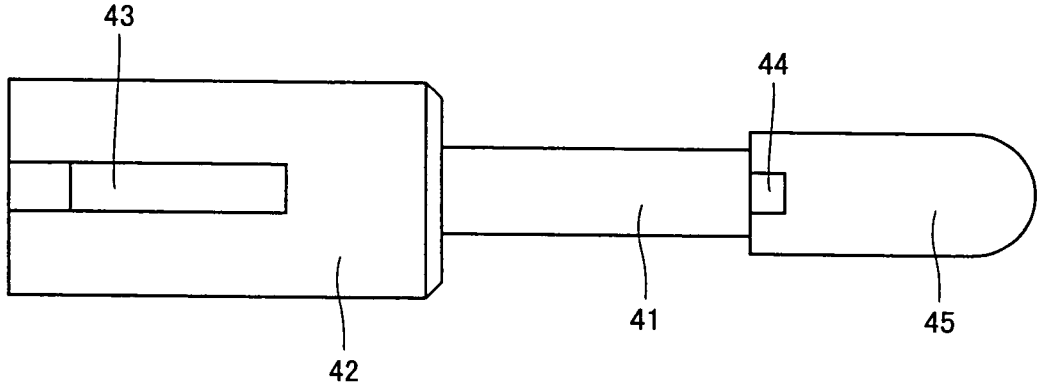
FIG. 13 is a plan view of the boss of the second embodiment illustrating the method of manufacturing it.

FIGS. 12 and 13 illustrate a method of manufacturing the boss of the present embodiment. FIG. 12 is a schematic cross section of the abutting portion and the pinching portion before the former is inserted into the latter. FIG. 13 is a plan view of the abutting portion and the pinching portion before the former is inserted into the latter. In the manufacturing process of the present embodiment, boss support 40, plate spring 41, pinching portion 42 and abutting portion 45 are integrally resin-molded.

In the present embodiment, abutting portion 45 is shaped as a cylinder and projection 44 is generally shaped as a cuboid. A band-shaped slide hole 43 is formed on the upper surface of pinching portion 42, which matches with the width of projection 44.

Referring to FIG. 12, plate spring 41 is bent several times, as indicated by arrow 66, to insert abutting portion 45 into pinching portion 42, thereby forming a boss of the present embodiment.

While in the present embodiment a plate spring 41 is bent such that the plate spring has three bending portions, it is not limited to this particular form and it may be bent in any geometry. For example, plate spring 41 may be bent such that the plate spring has two points of inflection.

Further, in the present embodiment, the abutting portion, the plate spring and other components are integrally formed. This configuration improves the productivity. That is, it is not necessary to fabricate a plurality of members, leading to a simpler manufacturing process. The manufacture of the boss is not limited to this form and a plurality of members may be joined. In this case, too, the plate spring and the pinching portion are preferably formed of an elastic material, for example the plate spring is preferably formed of a nylon material.

The other effects and advantages are the same as in the first embodiment and will not be described again. The portions in these figures that are identical with or corresponding to those of the first embodiment are labeled with the same reference numbers.

Third Embodiment

Referring to FIGS. 14 to 17, a laser beam printer apparatus of the present embodiment will be described. The laser beam printer apparatus of the present embodiment is different from the second embodiment in the plate spring.

Figure 14:
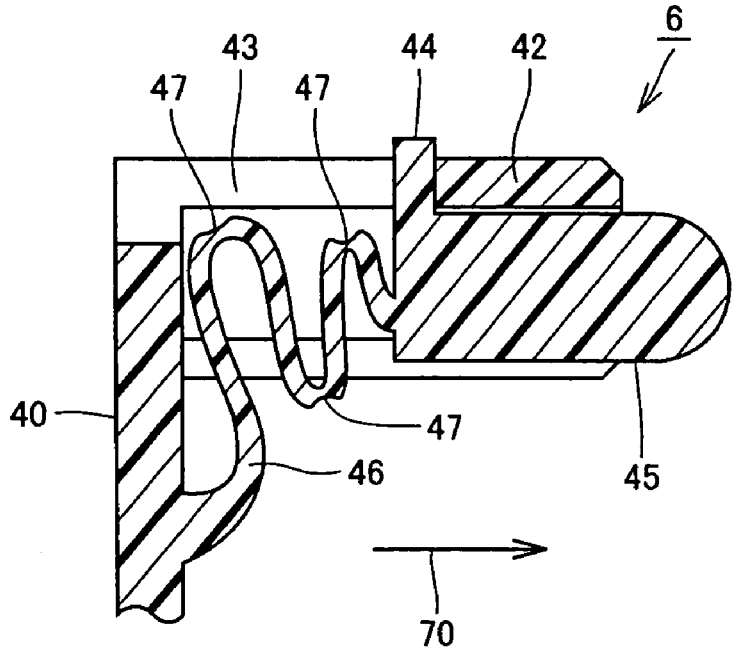
FIG. 14 is a cross sectional view of a boss of a third embodiment.
Figure 15:
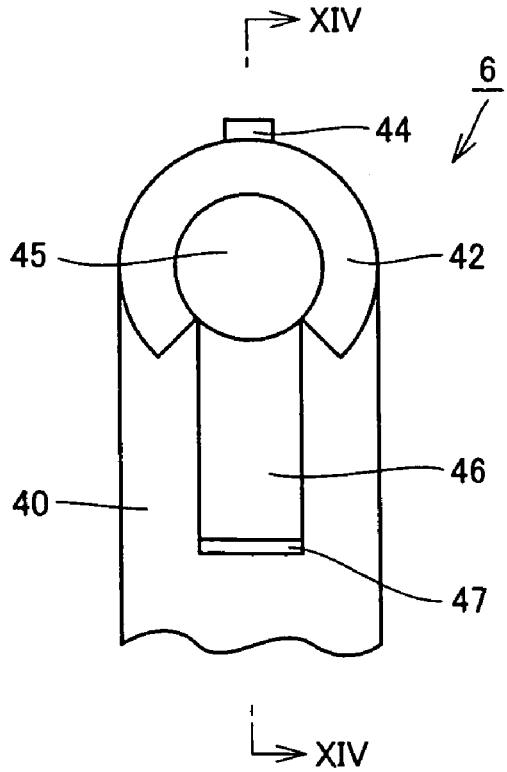
FIG. 15 is a front view of the boss of the third embodiment.

FIG. 14 shows a schematic cross section of a boss of the present embodiment. FIG. 15 shows a front view of the boss of the present embodiment. FIG. 14 is a view in the direction of the arrow of XIV-XIV in FIG. 15.

The boss of the present embodiment has a boss support 40, abutting portion 45, plate spring 46 and a pinching portion 42 which are integrally formed. Boss 6 has a plate spring 46 for biasing abutting portion 45 toward the guide groove, as indicated by arrow 70. Plate spring 46 is shaped as a plate. Plate spring 46 has one end joined with abutting portion 45 and the other end joined with boss support 40. Plate spring 46 is formed of an elastic material.

The plate spring 46 of the present embodiment has a bent portion 47. Bent portion 47 has a configuration with both front and back surfaces of plate spring 46 notched. Bent portion 47 has a section recessed with respect to the surface of plate spring 46. At bent portion 47, plate spring 46 has a smaller thickness. Plate spring 46 is bent at bent portion 47 as viewed in its cross section. The present embodiment has three bent portions 47. Plate spring 46 is curved between bent portions 47.

The rest of the construction is the same as in the first and second embodiments and thus will not be described again.

Referring to FIG. 14, abutting portion 45 of the present embodiment is biased in the direction indicated by arrow 70 by plate spring 46. Plate spring 46 has a bent portion 47 which allows fixing the position where plate spring 46 can be bent, thereby providing a plate spring 46 with a stable elasticity. That is, the point of reverse curve of plate spring 46 as viewed in the cross section can be determined, thereby reducing individual differences. As a result, abutting portion 45 can be biased with a substantially constant force.

Figure 16:
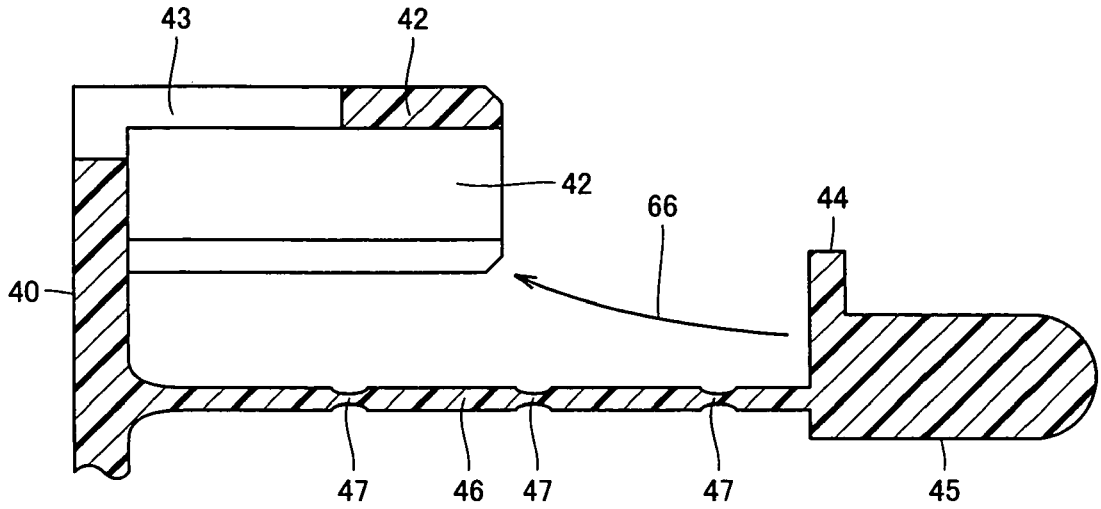
FIG. 16 is a cross sectional view of the boss of the third embodiment illustrating a method of manufacturing it.
Figure 17:
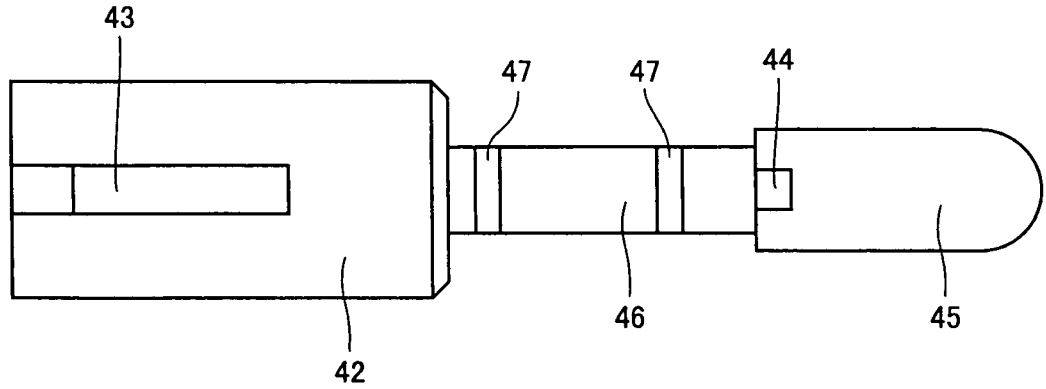
FIG. 17 is a plan view of the boss of the third embodiment illustrating the method of manufacturing it.

FIGS. 16 and 17 illustrate a method of manufacturing the boss of the present embodiment. FIG. 16 is a schematic cross section of the abutting portion and the pinching portion before the former is inserted into the latter. FIG. 17 is a plan view of the abutting portion and the pinching portion before the former is inserted into the latter. In the manufacturing process of the present embodiment, boss support 40, plate spring 46, pinching portion 42 and abutting portion 45 are integrally resin-molded. In the present embodiment, three bent portions 47 are formed in plate spring 46. Bent portions 47 are formed on the front and back major surfaces of plate spring 46.

Referring to FIG. 16, abutting portion 45 is brought close to pinching portion 42 by inflecting plate spring 46 several times, as indicated by arrow 66. Plate spring 46 is bent at bent portions 47. Abutting portion 45 is inserted into pinching portion 42 to fabricate the boss of the present embodiment. Bent portions 47 of plate spring 46 facilitate the bending of plate spring 46. Or, they facilitate the insertion of abutting portion 45 into pinching portion 42.

While in the present embodiment the plate spring is formed with three bent portions, it is not limited to this form and any number of bent portion(s) can be formed. For example, the plate spring may be formed with two bent portions.

Further, while in the present embodiment a bent portion is provided on both front and back major surfaces of the plate spring, recessed with respect to the surfaces, it is not limited to this form and a bent portion may have a recessed section on one of the front and back major surfaces.

The other effects, advantages and manufacturing processes are the same as in the first and second embodiments and will not be described again. The portions in these figures that are identical with or corresponding to those of the first and second embodiments are labeled with the same reference characters.

According to the present invention, a printer apparatus and a laser beam printer apparatus can be provided that allows an open/close door to be precisely positioned and fixed when the open/close door is closed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A laser beam printer apparatus comprising:

a rear door configured to be openable/closable around a rotational axis that is an axis extending in a width direction of its base portion;

a cylindrical photosensitive drum;

a cylindrical transfer roller fixed to said rear door, the transfer roller being disposed to be contactable with said photosensitive drum in a line when said rear door is closed;

a holding member including a guide groove extending toward a backside; and a hook for restraining said rear door in a closed state, wherein said rear door includes: a rear latch engaging said hook when said rear door is closed; and a boss configured to be partially inserted into said guide groove when said rear door is being closed, said holding member has a hole that is circular in shape in a plan view at a bottom of said guide groove in a position where said boss is disposed when said rear door is closed, said boss includes:

a cylindrical case that opens at one end portion at one boss end facing said guide groove;

a cylindrical abutting portion disposed within said case, the abutting portion being disposed to abut said guide groove;

an anchoring lug extending from said abutting portion toward another boss end opposite said one boss end, the anchoring lug configured to catch an end portion of said case at said other boss end; and a coil spring disposed within said case for biasing said abutting portion toward said one boss end, said guide groove is formed along a path along which said boss is moved as said rear door is opened/closed, said abutting portion has a spherical tip abutting said guide groove, said hole has a diameter in a plan view that is smaller than that of said abutting portion, when said rear door is closed, said rear latch engages said hook to restrain said rear door in a closed state, when said rear door is being closed, part of said boss is inserted into said guide groove, and said tip fits into said hole such that a closed position of said rear door is fixed.

2. A printer apparatus comprising:

an open/close door configured to be openable/closable around a rotational axis that is an axis extending in one direction; and a frame including a guide groove for guiding said open/close door to a position where said open/close door is to be stopped when said open/close door is being closed, wherein said open/close door includes a boss configured to be partially inserted into said guide groove when said open/close door is being closed, said guide groove is recessed in every section where it guides the boss, said boss includes an abutting portion biased toward one boss end facing said guide groove, said frame includes a recess or a through hole at the recessed section of said guide groove in a position where said abutting portion abuts it when said open/close door is closed, said boss is configured such that a tip fits into said recess or said through hole when said open/close door is closed, and said boss is configured such that said tip is removed from said recess or said through hole when said open/close door is being opened.

3. The printer apparatus according to claim 2, wherein said abutting portion is cylindrical, said abutting portion is shaped such that a tip at said one boss end is spherical, said hole or said recess is circular in shape in a plan view, and said tip has a diameter that is larger than that of said hole.

4. The printer apparatus according to claim 2, wherein said boss includes:

a boss support;

said abutting portion that is shaped as a rod;

a pinching portion configured to pinch said abutting portion while permitting it to be moved toward said one boss end; and a plate spring extending from said abutting portion for biasing said abutting portion toward said one boss end, said plate spring is fixed to said boss support on an end opposite that connected with said abutting portion, and said plate spring is formed to be bent.

5. The printer apparatus according to claim 4, wherein said abutting portion is cylindrical, said abutting portion is shaped such that a tip at said one boss end is spherical, said hole or said recess is circular in shape in a plan view, and said tip has a diameter that is larger than that of said hole.

6. A printer apparatus comprising:

an open/close door configured to be openable/closable around a rotational axis that is an axis extending in one direction; and a frame including a guide groove for guiding said open/close door to a position where said open/close door is to be stopped when said open/close door is being closed, wherein said open/close door includes a boss configured to be partially inserted into said guide groove when said open/close door is being closed, said boss includes:

an abutting portion biased toward one boss end facing said guide groove;

a pipe-shaped case that opens at an end portion at said one boss end;

said abutting portion that is shaped as a rod disposed within said case, the abutting portion configured to be movable toward said one boss end;

an anchoring lug extending from said abutting portion, the anchoring lug configured to catch an end portion of said case at a boss end opposite said one boss end; and a coil spring disposed within said case for biasing said abutting portion toward said one boss end, said frame includes a recess or a through hole at said guide groove in a position where said abutting portion abuts it when said open/close door is closed, said boss is configured such that a tip fits into said recess or said through hole when said open/close door is closed, and said boss is configured such that said tip is removed from said recess or said through hole when said open/close door is being opened.

7. The printer apparatus according to claim 6, wherein said abutting portion is cylindrical, said abutting portion is shaped such that a tip at said one boss end is spherical, said hole or said recess is circular in shape in a plan view, and said tip has a diameter that is larger than that of said hole.

* * * * *